US009865922B2

(12) United States Patent
Kerr et al.

(10) Patent No.: US 9,865,922 B2
(45) Date of Patent: Jan. 9, 2018

(54) ANTENNA TUNING CIRCUITRY WITH REDUCED INTERFERENCE

(71) Applicant: RF Micro Devices, Inc., Greensboro, NC (US)

(72) Inventors: Daniel Charles Kerr, Oak Ridge, NC (US); Christian Rye Iversen, Vestbjerg (DK); Eric K. Bolton, Kernersville, NC (US); Ruediger Bauder, Feldkirchen-Westerham (DE); Nadim Khlat, Cugnaux (FR)

(73) Assignee: Qorvo US, Inc., Greensboro, NC (US)

( * ) Notice: Subject to any disclaimer, the term of this patent is extended or adjusted under 35 U.S.C. 154(b) by 159 days.

(21) Appl. No.: 14/465,142

(22) Filed: Aug. 21, 2014

(65) Prior Publication Data

US 2015/0054698 A1 Feb. 26, 2015

Related U.S. Application Data

(60) Provisional application No. 61/868,154, filed on Aug. 21, 2013.

(51) Int. Cl.
*H01Q 5/328* (2015.01)
*H01Q 5/335* (2015.01)

(52) U.S. Cl.
CPC ..... *H01Q 5/328* (2015.01); *H01Q 5/335* (2015.01)

(58) Field of Classification Search
CPC ..... H01Q 5/328; H01Q 9/0442; H01Q 5/314; H01Q 5/335; H01Q 13/103; H01Q 7/005
See application file for complete search history.

(56) References Cited

U.S. PATENT DOCUMENTS

2011/0102290 A1* 5/2011 Milosavljevic ..... H01Q 1/243 343/852
2012/0009887 A1* 1/2012 Sanguinetti ..... H04B 1/18 455/78
2014/0287794 A1* 9/2014 Akhi ..... H04B 1/525 455/550.1

OTHER PUBLICATIONS

De Jongh, Maurice A., et al., "Mobile Phone Performance Improvements Using an Adaptively Controlled Antenna Tuner," 2011 IEEE/MTT-S International Microwave Symposium Digest (MTT), Jun. 5-10, 2011, 4 pages.

(Continued)

*Primary Examiner* — Robert Karacsony
(74) *Attorney, Agent, or Firm* — Withrow & Terranova, P.L.L.C.

(57) ABSTRACT

Antenna tuning circuitry includes an antenna tuning node, an antenna tuning switch, and a resonant tuning circuit. The antenna tuning node is coupled to a resonant conduction element of an antenna. The antenna tuning switch and the resonant tuning circuit are coupled in series between the antenna tuning switch and the antenna tuning node, such that the resonant tuning circuit is between the antenna tuning node and the antenna tuning switch. The resonant tuning circuit is configured to resonate at one or more harmonic frequencies generated by the antenna tuning switch such that a high impedance path is formed between the antenna tuning switch and the antenna tuning node at harmonic frequencies generated by the antenna tuning switch. Accordingly, harmonic interference generated by the antenna tuning switch is prevented from reaching the antenna, while simultaneously allowing for tuning of the antenna.

18 Claims, 7 Drawing Sheets

(56) References Cited

OTHER PUBLICATIONS

Sonnerat, F., et al., "Innovative Tunable Antenna Solution Using CMOS SOI Technology," 2012 IEEE International SOI Conference (SOI), Oct. 1-4, 2012, 2 pages.
Whatley, Richard, et al., "RF Front-End Tunability for LTE Handset Applications," 2010 IEEE Compound Semiconductor Integrated Circuit Symposium (CSICS), Oct. 3-6, 2010, 4 pages.

* cited by examiner

ANTENNA TUNING CIRCUITRY WITH REDUCED INTERFERENCE

RELATED APPLICATIONS

This application claims the benefit of U.S. provisional patent application Ser. No. 61/868,154, filed Aug. 21, 2013, the disclosure of which is incorporated herein by reference in its entirety.

FIELD OF THE DISCLOSURE

The present disclosure relates to antenna tuning circuitry. Specifically, the present disclosure relates to antenna tuning circuitry including filtering circuitry configured to reduce harmonic distortion generated by switching elements in the antenna tuning circuitry.

BACKGROUND

Evolving wireless communications standards continue to demand extremely high performance from the antennas used in mobile handsets. Modern antennas are expected to be compact while maintaining a high quality factor and a broad operating bandwidth. Due to carrier aggregation applications, a single antenna may be required to simultaneously send and/or receive signals at five or more different bands. For example, in one carrier aggregation application, an antenna may be expected to simultaneously transmit a band 17 uplink signal, receive a band 17 downlink signal, receive a band 1 downlink signal, receive a global positioning system (GPS) signal, and send and receive WiFi signals. Generally, a standalone antenna cannot meet the demanding performance standards dictated by the wireless standards when transmitting and receiving multiple signals. Accordingly, antenna tuning circuitry is often coupled to an antenna in order to improve the performance of the antenna. Specifically, the antenna tuning circuitry is generally configured to selectively couple one or more impedances to a resonant conducting element in the antenna in order to alter the resonant frequency of the resonant conducting element. The antenna may thus be "tuned" to a specific frequency or group of frequencies, which may increase the performance of the antenna in certain operating conditions.

FIG. 1 shows conventional antenna tuning circuitry 10. The antenna tuning circuitry 10 is coupled to a resonant conducting element 12 of an antenna 14 via an antenna tuning node 16. The conventional antenna tuning circuitry 10 includes a first antenna tuning inductor $L_{AT1}$, a second antenna tuning inductor $L_{AT2}$, a third antenna tuning inductor $L_{AT3}$, a first antenna tuning switch $SW_{AT1}$, a second antenna tuning switch $SW_{AT2}$, and a third antenna tuning switch $SW_{AT3}$. The first antenna tuning inductor $L_{AT1}$ is coupled in series with the first antenna tuning switch $SW_{AT1}$ between the antenna tuning node 16 and ground. The second antenna tuning inductor $L_{AT2}$ is coupled in series with the second antenna tuning switch $SW_{AT2}$ between the antenna tuning node 16 and ground. Finally, the third antenna tuning inductor $L_{AT3}$ is coupled in series with the third antenna tuning switch $SW_{AT3}$ between the antenna tuning node 16 and ground. Control circuitry 18 is coupled to the first antenna tuning switch $SW_{AT1}$, the second antenna tuning switch $SW_{AT2}$, and the third antenna tuning switch $SW_{AT3}$ in order to control the state of the antenna tuning switches $SW_{AT}$.

In operation, the control circuitry 18 opens or closes the first antenna tuning switch $SW_{AT1}$, the second antenna tuning switch $SW_{AT2}$, and/or the third antenna tuning switch $SW_{AT3}$, either separately or together, in order to alter the impedance of the resonant conducting element 12 of the antenna 14. Changing the impedance of the resonant conducting element 12 effectively changes the resonant frequency thereof, thereby "tuning" the antenna 14 to a desired frequency or frequencies. Accordingly, the antenna 14 may more easily transmit or receive signals about a desired frequency or frequencies.

Although effective at "tuning" the antenna 14, the switching components present in the conventional antenna tuning circuitry 10 may degrade the performance of the antenna 14 in certain operating conditions. Specifically, the first antenna tuning switch $SW_{AT1}$, the second antenna tuning switch $SW_{AT2}$, and/or the third antenna tuning switch $SW_{AT3}$ may generate harmonic signals, which are subsequently delivered to receive circuitry attached to the antenna 14 and/or transmitted from the antenna 14. Because the harmonic signals may be generated in response to a high-power transmit signal, such harmonic signals may cause desensitization of the receive circuitry, particularly when operating in a carrier aggregation configuration in which a receive frequency band includes one or more harmonic frequencies of a transmit signal. For example, a carrier aggregation configuration in which signals are simultaneously transmitted and received about bands 4 and 17 may be problematic, as the third harmonic of the band 17 uplink frequency range (704-716 MHz) falls squarely within the band 4 downlink frequency range (2110-2155 MHz).

Accordingly, there is a need for antenna tuning circuitry capable of altering the impedance and thus the resonant frequency of one or more resonant conducting elements in an antenna, while simultaneously avoiding or mitigating the generation of harmonic interference by the antenna tuning circuitry.

SUMMARY

The present disclosure relates to antenna tuning circuitry. In one embodiment, antenna tuning circuitry includes an antenna tuning node, an antenna tuning switch, and a resonant tuning circuit. The antenna tuning node is coupled to a resonant conduction element of an antenna. The antenna tuning switch and the resonant tuning circuit are coupled in series between the antenna tuning switch and the antenna tuning node, such that the resonant tuning circuit is between the antenna tuning node and the antenna tuning switch. The resonant tuning circuit is configured to resonate at one or more harmonic frequencies generated by the antenna tuning switch such that a high impedance path is formed between the antenna tuning switch and the antenna tuning node at harmonic frequencies generated by the antenna tuning switch. Accordingly, harmonic interference generated by the antenna tuning switch is prevented from reaching the antenna, while simultaneously allowing for tuning of the antenna.

In one embodiment, antenna tuning circuitry includes an antenna tuning node, an antenna tuning switch, a fixed tuning impedance, and a resonant tuning circuit. The antenna tuning node is coupled to a resonant conduction element of an antenna. The antenna tuning switch is coupled in series with the fixed tuning impedance between the antenna tuning node and ground. The resonant tuning circuit is coupled between the antenna tuning node and ground, and is configured to resonate at one or more harmonic frequencies generated by the antenna tuning switch such that a low impedance path is formed between the antenna tuning switch and ground. Accordingly, harmonic interference generated by the antenna tuning switch is shorted to ground, thereby preventing the harmonic interference from reaching the antenna, while simultaneously allowing for tuning of the antenna.

In one embodiment, an antenna comprises a low-band resonant conduction element, a high-band resonant conduction element, and antenna tuning circuitry. The antenna tuning circuitry includes an antenna tuning node, an antenna tuning switch, and a resonant tuning circuit. The antenna tuning node is coupled to the high-band resonant conduction element and the low-band resonant conduction element of the antenna. The antenna tuning switch and the resonant tuning circuit are coupled in series between the antenna tuning switch and the antenna tuning node, such that the resonant tuning circuit is between the antenna tuning node and the antenna tuning switch. The resonant tuning circuit is configured to resonate at one or more harmonic frequencies generated by the antenna tuning switch such that a high impedance path is formed between the antenna tuning switch and the antenna tuning node at harmonic frequencies generated by the antenna tuning switch. Accordingly, harmonic interference generated by the antenna tuning switch is prevented from reaching the antenna, while simultaneously allowing for tuning of the antenna.

In one embodiment, an antenna comprises a low-band resonant conduction element, a high-band resonant conduction element, and antenna tuning circuitry. The antenna tuning circuitry includes an antenna tuning node, an antenna tuning switch, a fixed tuning impedance, and a resonant tuning circuit. The antenna tuning node is coupled to a resonant conduction element of an antenna. The antenna tuning switch is coupled in series with the fixed tuning impedance between the antenna tuning node and ground. The resonant tuning circuit is coupled between the antenna tuning node and ground, and is configured to resonate at one or more harmonic frequencies generated by the antenna tuning switch such that a low impedance path is formed between the antenna tuning node and ground. Accordingly, harmonic interference generated by the antenna tuning switch is shorted to ground, thereby preventing the harmonic interference from reaching the antenna, while simultaneously allowing for tuning of the antenna.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 1:
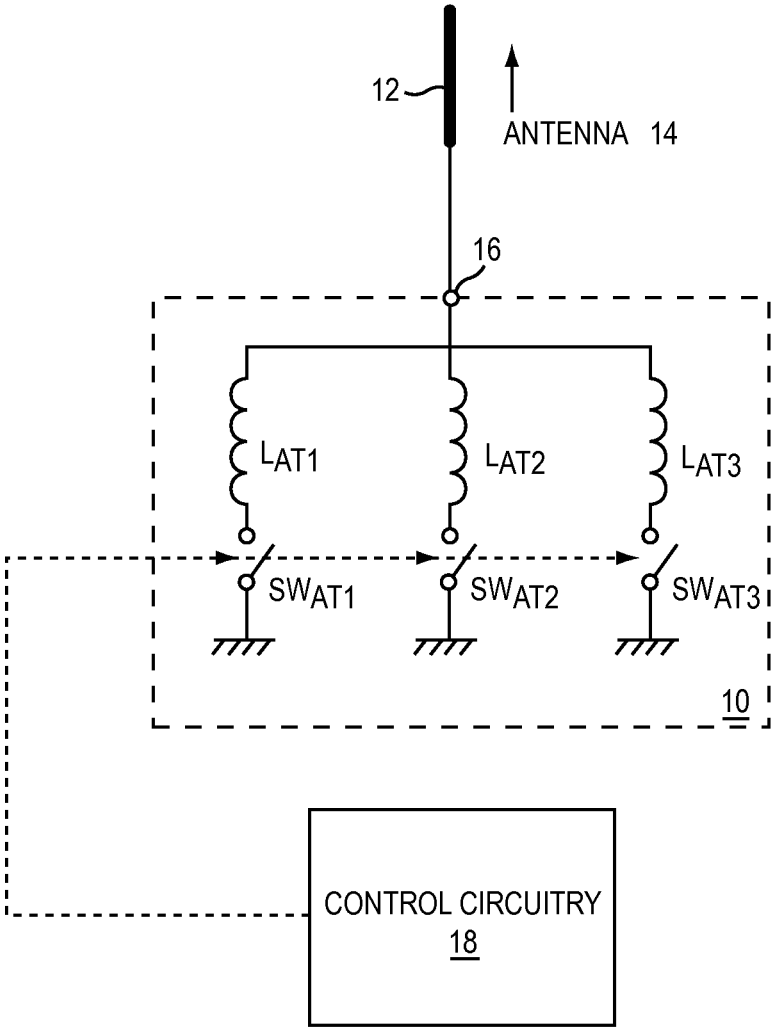
FIG. 1 (RELATED ART)
FIG. 1 is a schematic representation of conventional antenna tuning circuitry.
Figure 2:
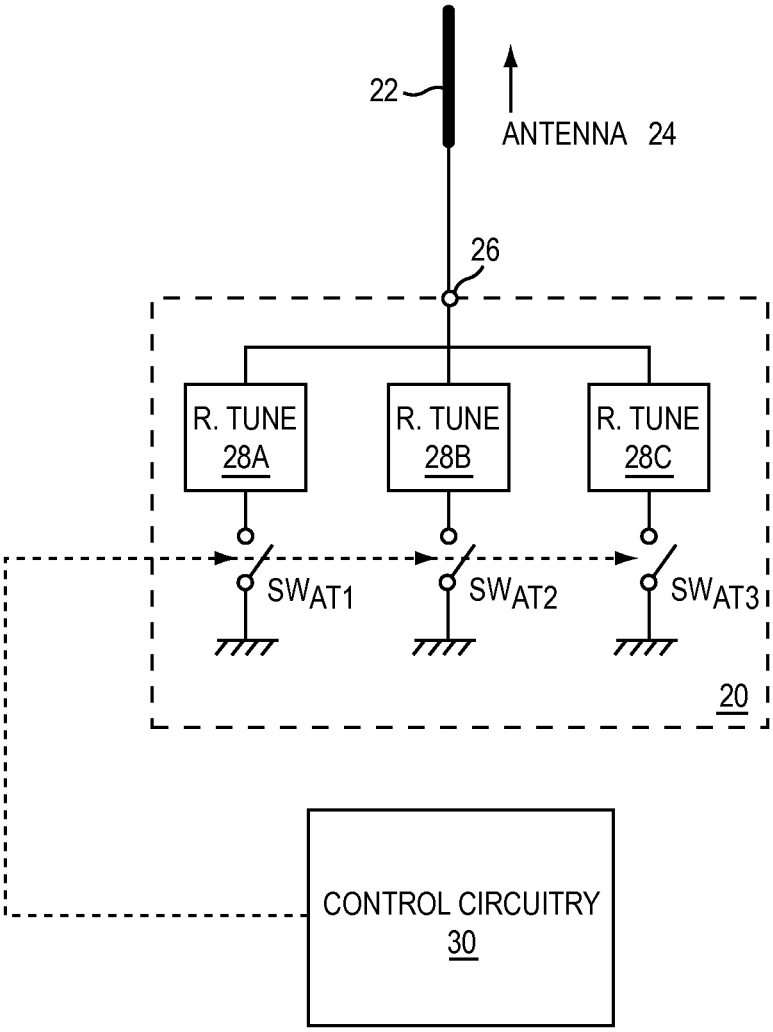
FIG. 2 is a schematic representation of antenna tuning circuitry according to one embodiment of the present disclosure.

Turning now to FIG. 2, antenna tuning circuitry 20 is shown according to one embodiment of the present disclosure. The antenna tuning circuitry 20 is coupled to a resonant conducting element 22 of an antenna 24 through an antenna tuning node 26. The antenna tuning circuitry 20 includes a first resonant tuning circuit 28A, a second resonant tuning circuit 28B, a third resonant tuning circuit 28C, a first antenna tuning switch $SW_{AT1}$, a second antenna tuning switch $SW_{AT2}$, and a third antenna tuning switch $SW_{AT3}$. The first resonant tuning circuit 28A is coupled in series with the first antenna tuning switch $SW_{AT1}$ between the antenna tuning node 26 and ground. The second resonant tuning circuit 28B is coupled in series with the second antenna tuning switch $SW_{AT2}$ and ground. The third resonant tuning circuit 28C is coupled in series with the third antenna tuning switch $SW_{AT3}$ between the antenna tuning node 26 and ground. Control circuitry 30 is coupled to each one of the first antenna tuning switch $SW_{AT1}$, the second antenna tuning switch $SW_{AT2}$, and the third antenna tuning switch $SW_{AT3}$, in order to control the state of each one of the antenna tuning switches $SW_{AT}$.

The first resonant tuning circuit 28A, the second resonant tuning circuit 28B, and the third resonant tuning circuit 28C are each associated with a particular impedance, which may be the same or different from one to the next. In operation, the control circuitry 30 opens and closes the first antenna tuning switch $SW_{AT1}$, the second antenna tuning switch $SW_{AT2}$, and/or the third antenna tuning switch $SW_{AT3}$, either separately or together, in order to alter the impedance of the resonant conducting element 22 of the antenna 24. Changing the impedance of the resonant conducting element 22 effectively changes the resonant frequency thereof, thereby "tuning" the antenna 24 to a desired frequency or frequencies. Accordingly, the antenna 24 may more easily transmit or receive signals about a desired frequency or frequencies. Additionally, the first resonant tuning circuit 28A, the second resonant tuning circuit 28B, and the third resonant tuning circuit 28C are each configured to resonate at one or more harmonic frequencies generated by the antenna tuning switch $SW_{AT}$ to which they are attached, as discussed in further detail below. When the first resonant tuning circuit 28A, the second resonant tuning circuit 28B, and the third resonant tuning circuit 28C resonate, they each produce a substantially high impedance, thereby blocking harmonic signals generated by the antenna tuning switch $SW_{AT}$ coupled to the circuitry from reaching the antenna tuning node 26 and thus the antenna 24. Accordingly, the antenna 24 may be tuned while simultaneously avoiding problematic harmonic distortion.

Although three resonant tuning circuits 28 coupled in series with three antenna tuning switches $SW_{AT}$ are shown in FIG. 2, any number of antenna tuning switches $SW_{AT}$ and corresponding resonant tuning circuits 28 may be used without departing from the principles of the present disclosure. Further, one or more static impedance elements, for example, a tuning inductor or a tuning capacitor (not shown), may additionally be coupled between the antenna tuning node 26 and ground in some embodiments. Since the static impedance elements do not contain switching elements that may generate problematic harmonic signals, a resonant tuning circuit 28 is not required to be coupled in series with these elements. The control circuitry 30 may store one or more antenna tuning switch configuration presets, such that a particular configuration of the antenna tuning switches $SW_{AT}$ is associated with transmitting or receiving a particular signal, and thus is implemented in that scenario. Each one of the resonant tuning circuits 28 may comprise any suitable components capable of providing a desired impedance while also resonating at one or more harmonic frequencies of the antenna tuning switch $SW_{AT}$ to which the resonant tuning circuit 28 is coupled. The antenna tuning switches $SW_{AT}$ may be field-effect transistors (FETs), metal-oxide-semiconductor field-effect transistors (MOSFETs), insulated gate bipolar-junction transistors (IGBTs), high electron mobility transistors (HEMTs), bipolar junction transistors (BJTs), or the like. Further, the antenna tuning switches $SW_{AT}$ may be fabricated in a variety of material systems, for example, silicon (Si), semiconductor on insulator (SOI), gallium arsenide (GaAs), gallium nitride (GaN), and the like. In one embodiment, one or more portions of the resonant tuning circuits 28 are monolithically integrated on a semiconductor die with the antenna tuning switches $SW_{AT}$, as discussed in further detail below.

Figure 3:
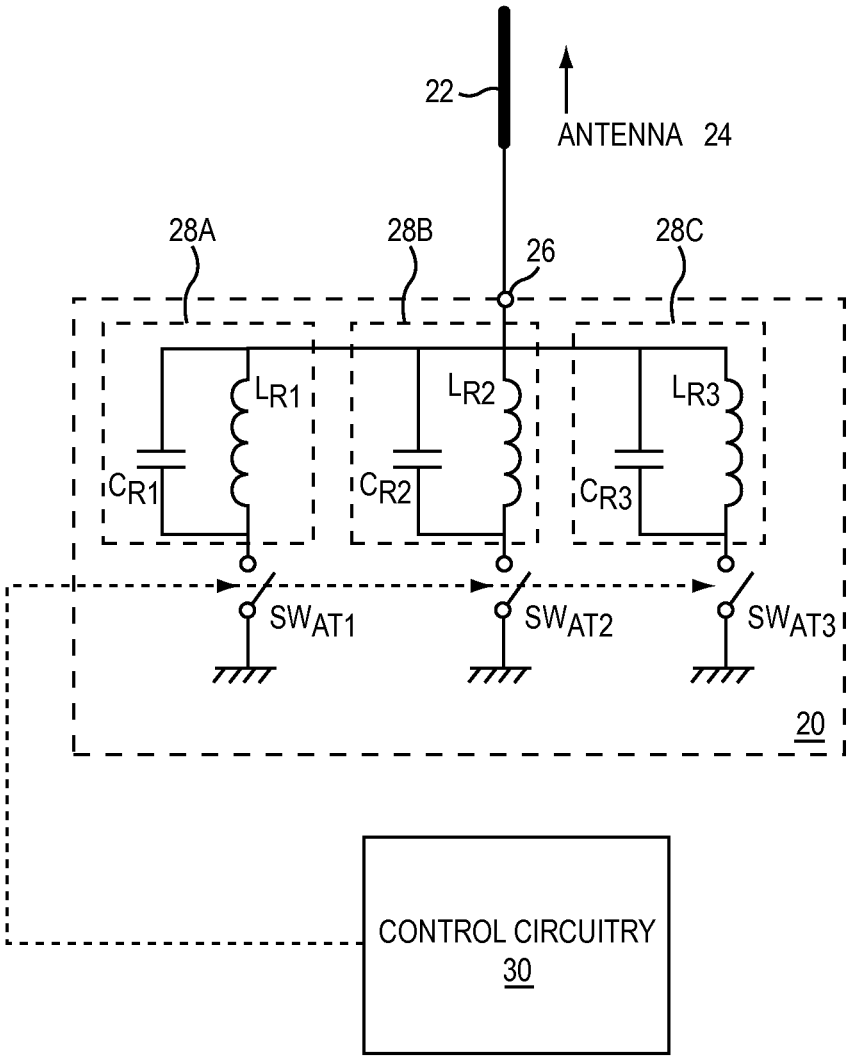
FIG. 3 is a schematic representation of antenna tuning circuitry according to an additional embodiment of the present disclosure.

FIG. 3 shows details of the antenna tuning circuitry 20 according to one embodiment of the present disclosure. As shown in FIG. 3, the first resonant tuning circuit 28A includes a first resonant capacitor $C_{R1}$ coupled in parallel with a first resonant inductor $L_{R1}$ between the antenna tuning node 26 and the first antenna tuning switch $SW_{AT1}$. The second resonant tuning circuit 28B includes a second resonant capacitor $C_{R2}$ coupled in parallel with a second resonant inductor $L_{R2}$ between the antenna tuning node 26 and the second antenna tuning switch $SW_{AT2}$. The third resonant tuning circuit 28C includes a third resonant capacitor $C_{R3}$ coupled in parallel with a third resonant inductor $L_{R3}$ between the antenna tuning node 26 and the third antenna tuning switch $SW_{AT3}$.

As discussed above, the values of the first resonant capacitor $C_{R1}$ and the first resonant inductor $L_{R1}$ are chosen such that the parallel combination of the first resonant capacitor $C_{R1}$ and the first resonant inductor $L_{R1}$ provides a desirable impedance value for presenting to the antenna tuning node 26 in order to tune the resonant conducting element 22 of the antenna 24, while simultaneously resonating at one or more harmonic frequencies generated by the first antenna tuning switch $SW_{AT1}$ in order to block harmonic signals generated by the first antenna tuning switch $SW_{AT1}$ from reaching the antenna tuning node 26 and thus the resonant conducting element 22 of the antenna 24. The values of the second resonant capacitor $C_{R2}$, the second resonant inductor $L_{R2}$, the third resonant capacitor $C_{R3}$, and the third resonant inductor $L_{R3}$ are chosen similarly, such that the combination of the second resonant capacitor $C_{R2}$ and the second resonant inductor $L_{R2}$ and the combination of the third resonant capacitor $C_{R3}$ and the third resonant inductor $L_{R3}$ provide a desirable impedance value for presenting to the antenna tuning node 26 in order to tune the resonant conducting element 22 of the antenna 24, while simultaneously resonating at one or more harmonic frequencies generated by the second antenna tuning switch $SW_{AT2}$ and the third antenna tuning switch $SW_{AT3}$, respectively in order to block harmonic signals generated by the second antenna tuning switch $SW_{AT2}$ and the third antenna tuning switch $SW_{AT3}$ from reaching the antenna tuning node 26 and thus the resonant conducting element 22 of the antenna 24.

Figure 4:
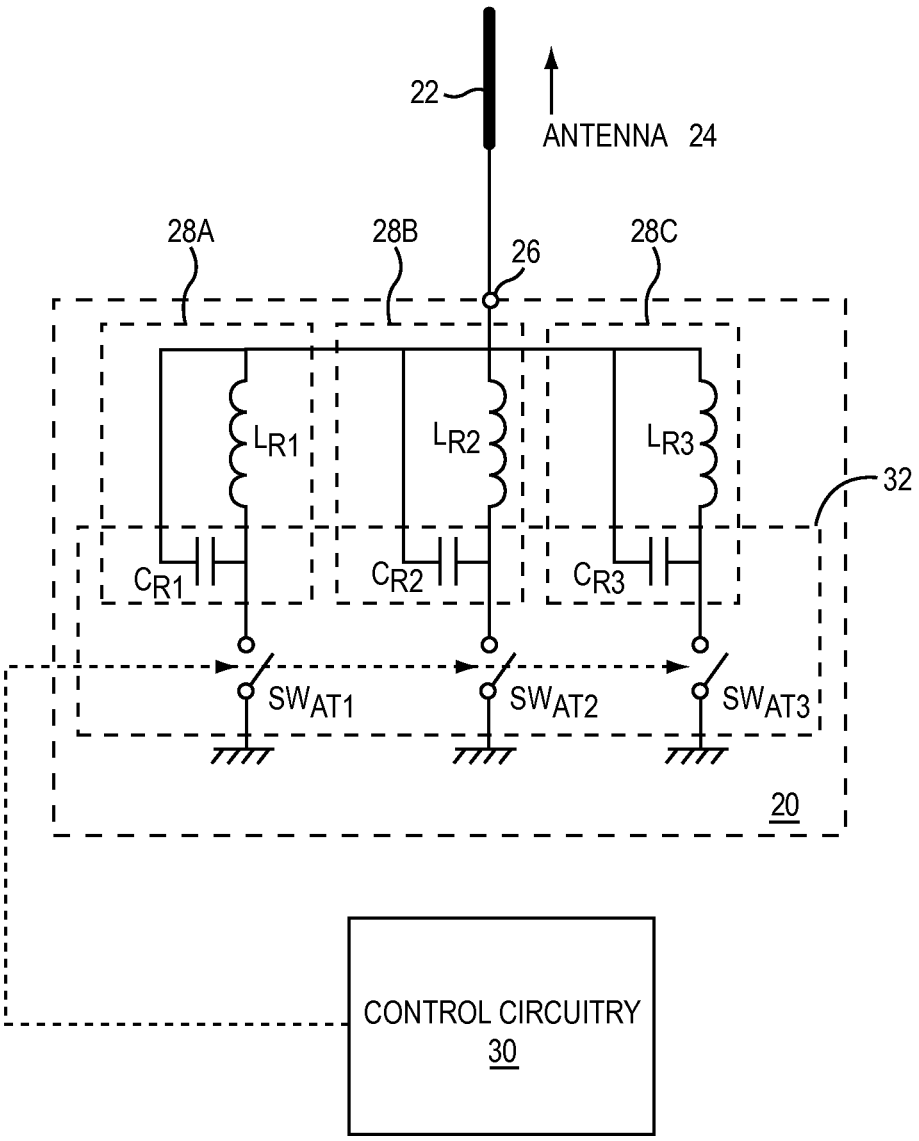
FIG. 4 is a schematic representation of antenna tuning circuitry according to an additional embodiment of the present disclosure.

FIG. 4 shows details of the antenna tuning circuitry 20 according to an additional embodiment of the present disclosure. The antenna tuning circuitry 20 shown in FIG. 4 is substantially similar to that shown in FIG. 3, but illustrates that each one of the first resonant capacitor $C_{R1}$, the second resonant capacitor $C_{R2}$, the third resonant capacitor $C_{R3}$, the first antenna tuning switch $SW_{AT1}$, the second antenna tuning switch $SW_{AT2}$, and the third antenna tuning switch $SW_{AT3}$, may be monolithically integrated on a semiconductor die, as illustrated by the dashed box 32. Monolithically integrating the first resonant capacitor $C_{R1}$, the second resonant capacitor $C_{R2}$, the third resonant capacitor $C_{R3}$, the first antenna tuning switch $SW_{AT1}$, the second antenna tuning switch $SW_{AT2}$, and the third antenna tuning switch $SW_{AT3}$ on a semiconductor die saves space in the antenna tuning circuitry 20, and further may reduce interference generated by trace inductances from connections between the various components.

Figure 5:
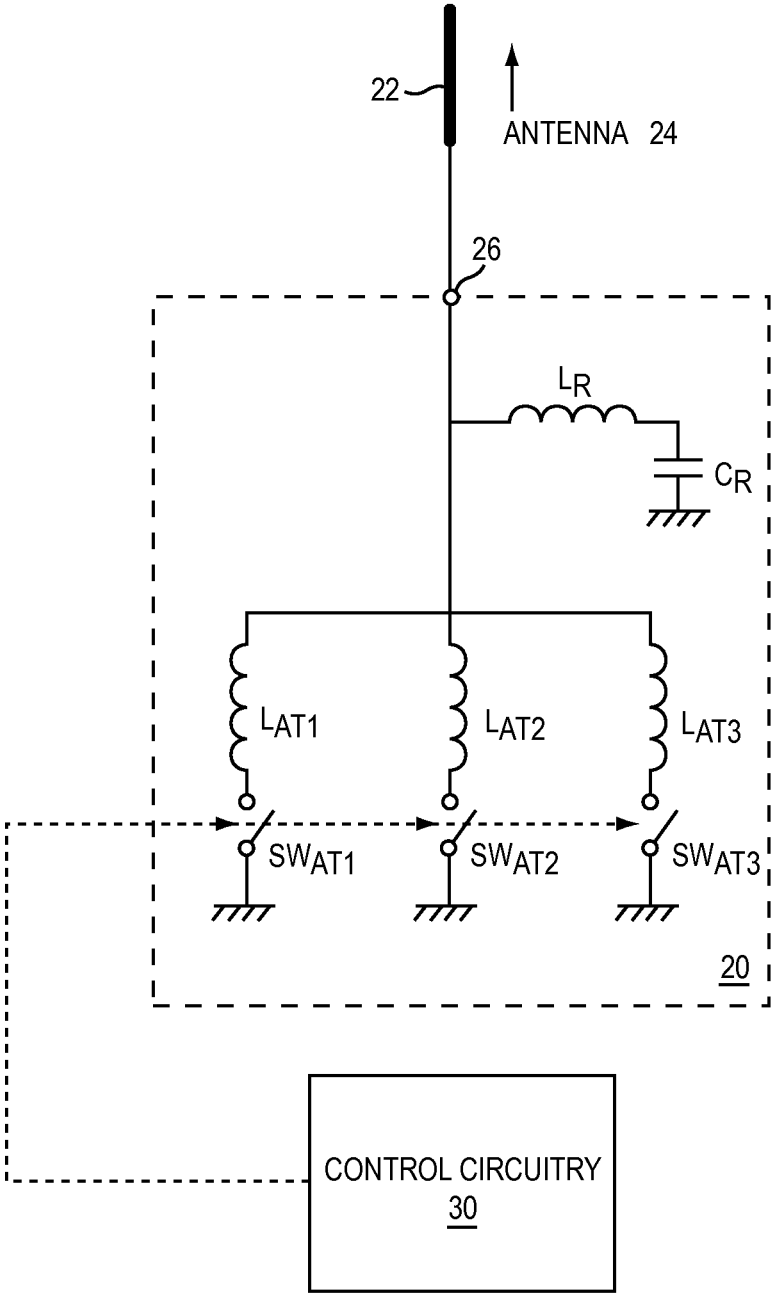
FIG. 5 is a schematic representation of antenna tuning circuitry according to an additional embodiment of the present disclosure.

FIG. 5 shows the antenna tuning circuitry 20 according to an additional embodiment of the present disclosure. The antenna tuning circuitry 20 is coupled to the resonant conducting element 22 of the antenna 24 through the antenna tuning node 26. The antenna tuning circuitry 20 includes a resonant capacitor $C_R$ coupled in series with a resonant inductor $L_R$ between the antenna tuning node 26 and ground. Further, the antenna tuning circuitry 20 includes a first fixed tuning impedance (e.g., a first antenna tuning inductor $L_{AT1}$) coupled in series with a first antenna tuning switch $SW_{AT1}$ between the antenna tuning node 26 and ground, a second fixed tuning impedance (e.g., a second antenna tuning inductor $L_{AT2}$) coupled in series with a second antenna tuning switch $SW_{AT2}$ between the antenna tuning node 26 and ground, and a third fixed tuning impedance (e.g., a third antenna tuning inductor $L_{AT3}$) coupled in series with a third antenna tuning switch $SW_{AT3}$ between the antenna tuning node 26 and ground. Although the fixed antenna tuning impedances are shown in FIG. 5 as antenna tuning inductors $L_{AT}$, any suitable fixed impedance components may be used for the fixed tuning impedances without departing from the principles of the present disclosure. The control circuitry 30 is coupled to each one of the first antenna tuning switch $SW_{AT1}$, the second antenna tuning switch $SW_{AT2}$, and the third antenna tuning switch $SW_{AT3}$, in order to control the state of each one of the antenna tuning switches $SW_{AT}$.

The resonant capacitor $C_R$ and the resonant inductor $L_R$ are configured to resonate at one or more harmonic frequencies generated by the first antenna tuning switch $SW_{AT1}$, the second antenna tuning switch $SW_{AT2}$, and the third antenna tuning switch $SW_{AT3}$. When the resonant capacitor $C_R$ and the resonant inductor $L_R$ resonate, they produce a substantially low impedance path from the antenna tuning node 26 to ground, thereby shorting harmonic signals generated by the first antenna tuning switch $SW_{AT1}$, the second antenna tuning switch $SW_{AT2}$, and the third antenna tuning switch $SW_{AT3}$ to ground and preventing harmonic distortion from reaching the antenna 24. Accordingly, the antenna 24 may be tuned while simultaneously avoiding problematic harmonic distortion.

Figure 6A:
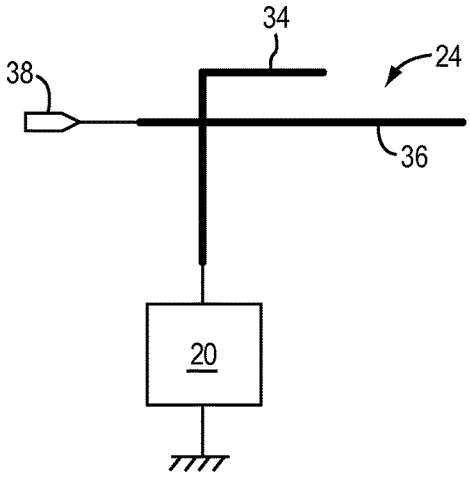
FIGS. 6A-6C are schematic representations of antennas including antenna tuning circuitry according to various embodiments of the present disclosure.
Figure 6B:
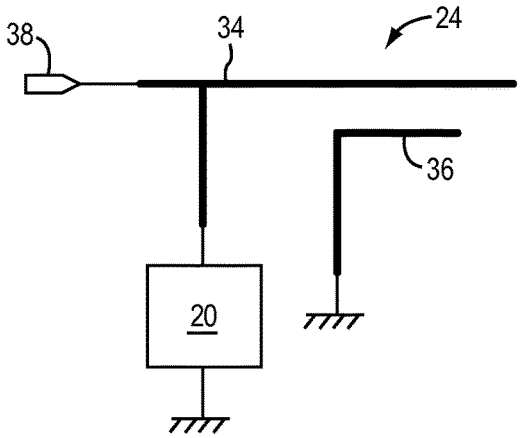
Figure 6C:
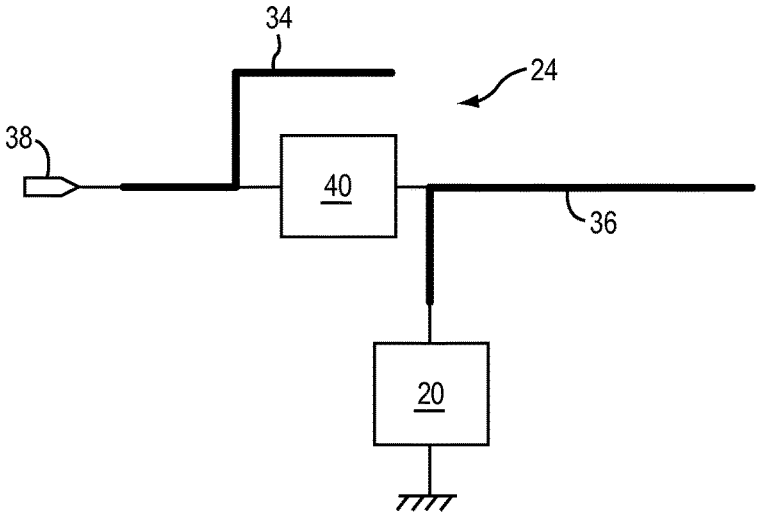

FIGS. 6A through 6C show various configurations of the antenna 24 including antenna tuning circuitry 20. In FIG. 6A, the antenna 24 includes a high-band resonant conducting element 34, a low-band resonant conducting element 36, an antenna feed 38, and the antenna tuning circuitry 20. The antenna 24 may be a microstrip antenna, and the high-band resonant conducting element 34 and the low-band resonant conducting element 36 may each be "inverted-L" elements. The antenna tuning circuitry 20 is coupled to the high-band resonant conducting element 34 and the low-band resonant conducting element 36 through the antenna tuning node 26. The control circuitry 30 may be coupled to the antenna tuning circuitry 20 in order to control when each one of the switches therein is opened or closed.

FIG. 6B shows an alternative configuration of the antenna 24. The antenna 24 shown in FIG. 6B is substantially similar to that shown in FIG. 6A, except that the high-band resonant conducting element 34 is not attached to the low-band resonant conducting element 36, but rather is left floating as a non-coupled element. In this case, the antenna tuning circuitry 20 may be coupled only to the low-band resonant conducting element 36, rather than both the high-band resonant conducting element 34 and the low-band resonant conducting element 36.

FIG. 6C shows yet another configuration of the antenna 24. The antenna 24 shown in FIG. 6C is substantially similar to that shown in FIG. 6A and FIG. 6B, except that the high-band resonant conducting element 34 is separated from the low-band resonant conducting element 36 by coupling circuitry 40, such that the high-band resonant conducting element 34 is coupled to the antenna feed 38. In this case, the antenna tuning circuitry 20 may be coupled to the low-band resonant conducting element 36, and in turn coupled to the high-band resonant conducting element 34 via the coupling circuitry 40. In some embodiments, the coupling circuitry 40 may also be the antenna tuning circuitry 20 discussed above.

Figure 7:
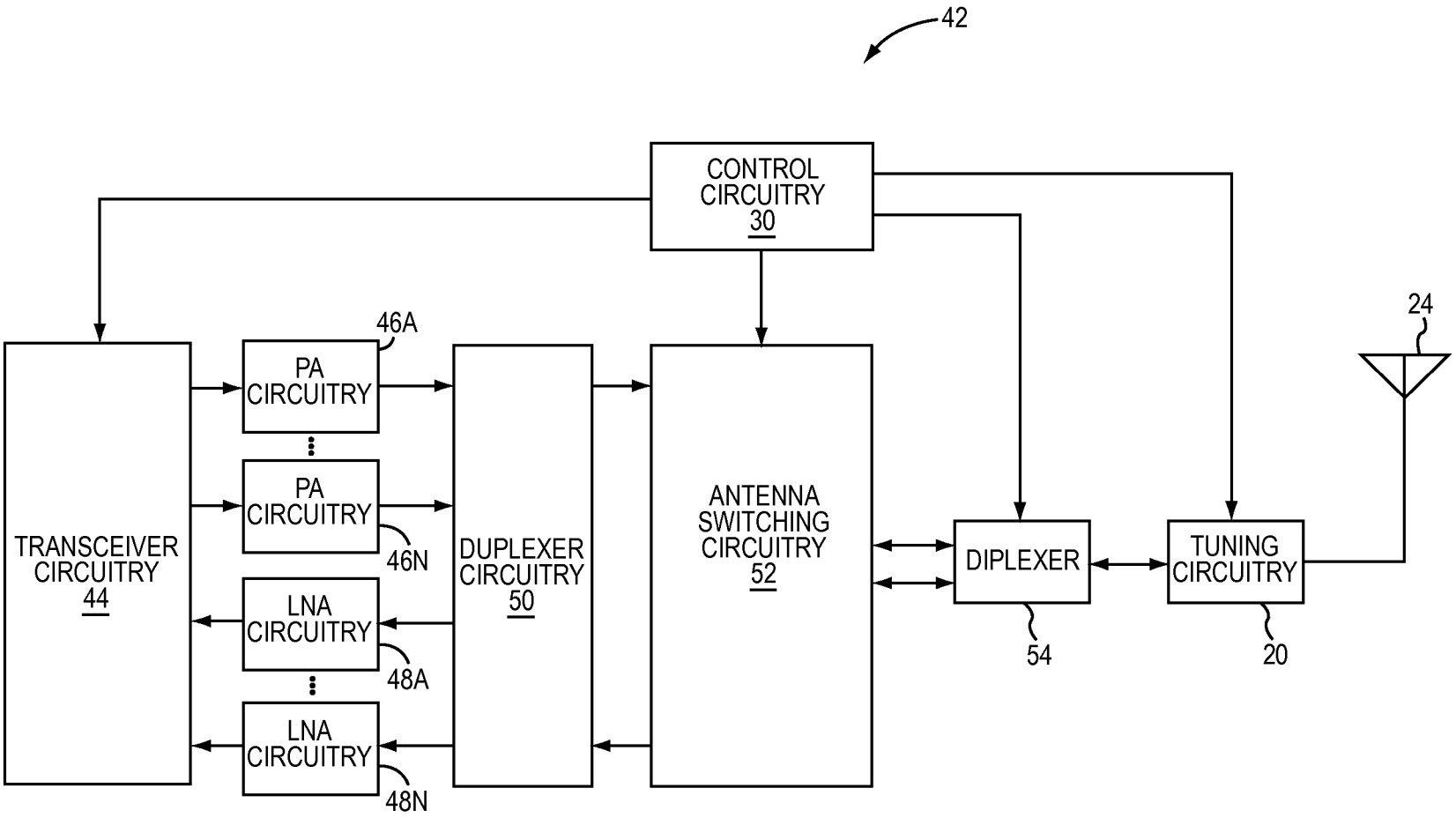
FIG. 7 is a block diagram showing radio frequency front end circuitry according to one embodiment of the present disclosure.

FIG. 7 shows radio frequency (RF) front end circuitry 42 including antenna tuning circuitry 20 according to one embodiment of the present disclosure. The basic architecture of the RF front end circuitry 42 includes transceiver circuitry 44, a plurality of power amplifiers 46A-46N, a plurality of low noise amplifiers 48A-48N, duplexer circuitry 50, antenna switching circuitry 52, a diplexer 54, the antenna tuning circuitry 20, the antenna 24, and the control circuitry 30. When receiving a signal, the antenna 24 of the RF front end circuitry 42 receives information bearing radio frequency signals at a receive frequency from one or more remote transmitters provided by a base station (not shown). The radio frequency signals pass through the antenna tuning circuitry 20, which may have previously set the impedance of the antenna 24 in order to optimize reception of signals about a desired receive frequency, to the diplexer 54, where the signals are filtered into their low band and high band components and delivered to the antenna switching circuitry 52. The antenna switching circuitry 52 selectively couples one or more terminals of the diplexer 54 to one or more of the plurality of low noise amplifiers 48A-48N through the duplexer circuitry 50. One or more of the plurality of low noise amplifiers 48A-48N amplify the received components of the radio frequency signals and deliver them to the transceiver circuitry 44, where they may be subsequently processed and used by the RF front end circuitry 42.

On the transmit side, the transceiver circuitry 44 receives digitized data, which may represent voice, data, or control information. The encoded data is modulated to produce a carrier signal at a desired transmit frequency. The carrier signal is then delivered to one or more of the plurality of power amplifiers 46A-46N, where it is amplified and delivered to the antenna switching circuitry 52, which may have previously set the impedance of the antenna 24 in order to optimize transmission of signals about a desired frequency, through the duplexer circuitry 50. The antenna switching circuitry 52 selectively couples one or more output terminals of the plurality of power amplifiers 46A-46N to the diplexer 54. The carrier signal is then filtered by the diplexer 54, and delivered through the antenna tuning circuitry 20 to the antenna 24. As discussed above, the antenna tuning circuitry 20 is configured to ensure optimal operation of the antenna 24 over a wide bandwidth, thereby increasing the performance of the RF front end circuitry 42. The control circuitry 30 may be configured to control not only the antenna tuning circuitry 20, but also one or more additional operating parameters of the transceiver circuitry 44, the antenna switching circuitry 52, and/or the diplexer 54.

Those skilled in the art will recognize improvements and modifications to the embodiments of the present disclosure.

All such improvements and modifications are considered within the scope of the concepts disclosed herein and the claims that follow.

What is claimed is:

1. Antenna tuning circuitry comprising:

an antenna tuning node coupled directly to a resonant conduction element of an antenna;

an antenna tuning switch;

a resonant tuning circuit coupled between the antenna tuning switch and the antenna tuning node such that the resonant tuning circuit is coupled directly to the antenna tuning node and the antenna tuning switch is coupled between the resonant tuning circuit and ground, the resonant tuning circuitry configured to resonate at one or more harmonic frequencies generated by the antenna tuning switch such that a high impedance path is formed between the antenna tuning switch and the antenna tuning node at the one or more harmonic frequencies generated by the antenna tuning switch, wherein when the antenna tuning switch is closed, the antenna tuning circuitry is configured to change an impedance of the resonant conduction element of the antenna such that a resonant frequency of the resonant conduction element is changed;

an additional antenna tuning switch; and an additional resonant tuning circuit coupled between the additional antenna tuning switch and the antenna tuning node and configured to resonate at one or more harmonic frequencies of the additional antenna tuning switch such that a high impedance path is formed between the additional antenna tuning switch and the antenna tuning node at the one or more harmonic frequencies generated by the additional antenna tuning switch.

2. The antenna tuning circuitry of claim 1 wherein the resonant tuning circuit comprises a resonant capacitor coupled in parallel with a resonant inductor.

3. The antenna tuning circuitry of claim 2 wherein the resonant capacitor and the antenna tuning switch are monolithically integrated on a semiconductor die.

4. The antenna tuning circuitry of claim 3 wherein the semiconductor die is a silicon-on-insulator (SOI) semiconductor die.

5. The antenna tuning circuitry of claim 1 wherein the resonant tuning circuit and the additional resonant tuning circuit each comprise a resonant capacitor coupled in parallel with a resonant inductor.

6. The antenna tuning circuitry of claim 5 wherein each one of the resonant tuning capacitors in the resonant tuning circuit and the additional resonant tuning circuit, the antenna tuning switch, and the additional antenna tuning switch, are monolithically integrated on a semiconductor die.

7. The antenna tuning circuitry of claim 6 wherein the semiconductor die is a silicon-on-insulator (SOI) semiconductor die.

8. Antenna circuitry comprising:

a low-band resonant conduction element;

a high-band resonant conduction element; and antenna tuning circuitry comprising:

an antenna tuning node coupled directly to one of the low-band resonant conduction element and the high-band resonant conduction element;

an antenna tuning switch;

a resonant tuning circuit coupled between the antenna tuning switch and the antenna tuning node such that the resonant tuning circuit is coupled directly to the antenna tuning node and the antenna tuning switch is coupled between the resonant tuning circuit and ground, the resonant tuning circuitry configured to resonate at one or more harmonic frequencies of the antenna tuning switch such that a high impedance path is formed between the antenna tuning switch and the antenna tuning node at the one or more harmonic frequencies generated by the antenna tuning switch, wherein when the antenna tuning switch is closed, the antenna tuning circuitry is configured to change an impedance of the resonant conduction element of the antenna such that a resonant frequency of the resonant conduction element is changed;

an additional antenna tuning switch; and an additional resonant tuning circuit coupled between the additional antenna tuning switch and the antenna tuning node and configured to resonate at one or more harmonic frequencies of the additional antenna tuning switch such that a high impedance path is formed between the additional antenna tuning switch and the antenna tuning node at the one or more harmonic frequencies generated by the additional antenna tuning switch.

9. The antenna circuitry of claim 8 wherein the resonant tuning circuit comprises a resonant capacitor coupled in parallel with a resonant inductor.

10. The antenna circuitry of claim 9 wherein the resonant capacitor and the antenna tuning switch are monolithically integrated on a semiconductor die.

11. The antenna circuitry of claim 10 wherein the semiconductor die is a silicon-on-insulator (SOI) semiconductor die.

12. The antenna circuitry of claim 8 wherein the resonant tuning circuit and the additional resonant tuning circuit each comprise a resonant capacitor coupled in parallel with a resonant inductor.

13. The antenna circuitry of claim 12 wherein each one of the resonant tuning capacitors in the resonant tuning circuit and the additional resonant tuning circuit, the antenna tuning switch, and the additional antenna tuning switch, are monolithically integrated on a semiconductor die.

14. The antenna circuitry of claim 13 wherein the semiconductor die is a silicon-on-insulator (SOI) semiconductor die.

15. The antenna circuitry of claim 8 wherein the antenna circuitry is configured to simultaneously:

receive a high-band receive signal via the high-band resonant conduction element; and transmit a low-band transmit signal via the low-band resonant conduction element.

16. The antenna circuitry of claim 15 wherein the resonant tuning circuit is configured to resonate at one or more harmonic frequencies of the low-band transmit signal.

17. The antenna circuitry of claim 16 wherein the low-band transmit signal is a band 17 uplink signal with a frequency range between about 704-716 MHz and the high-band receive signal is a band 4 downlink signal with a frequency range between about 2110-2155 MHz.

18. The antenna circuitry of claim 17 wherein the resonant tuning circuit is configured to resonate at a third harmonic frequency of the low-band transmit signal.

* * * * *